United States Patent [19]

Hurdle, Jr.

[11] Patent Number: 4,870,881

[45] Date of Patent: Oct. 3, 1989

[54] VERTICAL EDGER

[76] Inventor: Ennis J. Hurdle, Jr., Hwy. 57 East, Moscow, Tenn. 38057

[21] Appl. No.: 189,355

[22] Filed: May 2, 1988

[51] Int. Cl.[4] ..... B27B 7/02

[52] U.S. Cl. ..... 83/102.1; 83/404.1; 83/425.2; 83/435.1; 83/707

[58] Field of Search ..... 83/404.1, 404, 433, 83/102.1, 707, 425.2, 435.1, 520

[56] References Cited

U.S. PATENT DOCUMENTS 3,771,397 11/1973 Smith ..... 83/102.1

4,532,842 8/1985 McFarlane ..... 83/404.1

*Primary Examiner*—Donald R. Schran

*Attorney, Agent, or Firm*—Walker & McKenzie

[57] ABSTRACT

A vertical edger for cutting parallel horizontal kerfs in a log. The edger includes a first horizontal cutting blade; a second horizontal cutting blade; drive structure coupled to the horizontal cutting blades for rotatably driving the horizontal cutting blades; a first vertical column; a second vertical column spaced from the first vertical column; slide structure for attaching the first horizontal cutting blade to the vertical columns and for allowing the first horizontal cutting blade to move vertically along the vertical columns; the side structure including a first sleeve member slidably attached to the first vertical column, a second sleeve member slidably attached to the second vertical column, and a connector extending between the first and second sleeve members; and structure coupled to the slide structure for causing the slide structure to move vertically along the vertical columns and for causing the first horizontal cutting blade to move vertically along the vertical columns.

5 Claims, 2 Drawing Sheets

VERTICAL EDGER

BACKGROUND OF THE INVENTION

1. Field of the Invention

The present invention relates to a vertical edger for use in a sawmill to edge boards before the boards are cut from a log.

2. Description of the Related Art

The inventor is aware of the following patents which relate in general to the present invention: Anderegg it al, U.S. Pat. No. 2,822,006; Smith, U.S. Pat. No. 3,797,349; Large, U.S. Pat. No. 3,913,439; and Shepard, U.S. Pat. No. 4,015,648. None of the above patents disclose or suggest the present invention.

SUMMARY OF THE INVENTION

The present invention is directed toward providing a vertical edger for cutting parallel horizontal kerfs in a log.

The vertical edger of the present invention includes, in general, a first horizontal cutting blade; a second horizontal cutting blade; drive means coupled to the horizontal cutting blades for rotatably driving the horizontal cutting blades; a first vertical column; a second vertical column spaced from the first vertical column; slide means for attaching the first cutting blade to the vertical columns and for allowing the first cutting blade to move vertically along the vertical columns, the slide means including a first sleeve member slidably attached to the first vertical column, a second sleeve member slidably attached to the second vertical column, and a connector extending between the first and second sleeve members; and means coupled to the slide means for causing the slide means to move vertically along the vertical columns and for causing the first horizontal cutting blade to move vertically along the vertical columns.

DESCRIPTION OF THE PREFERRED EMBODIMENT

Figure 1:
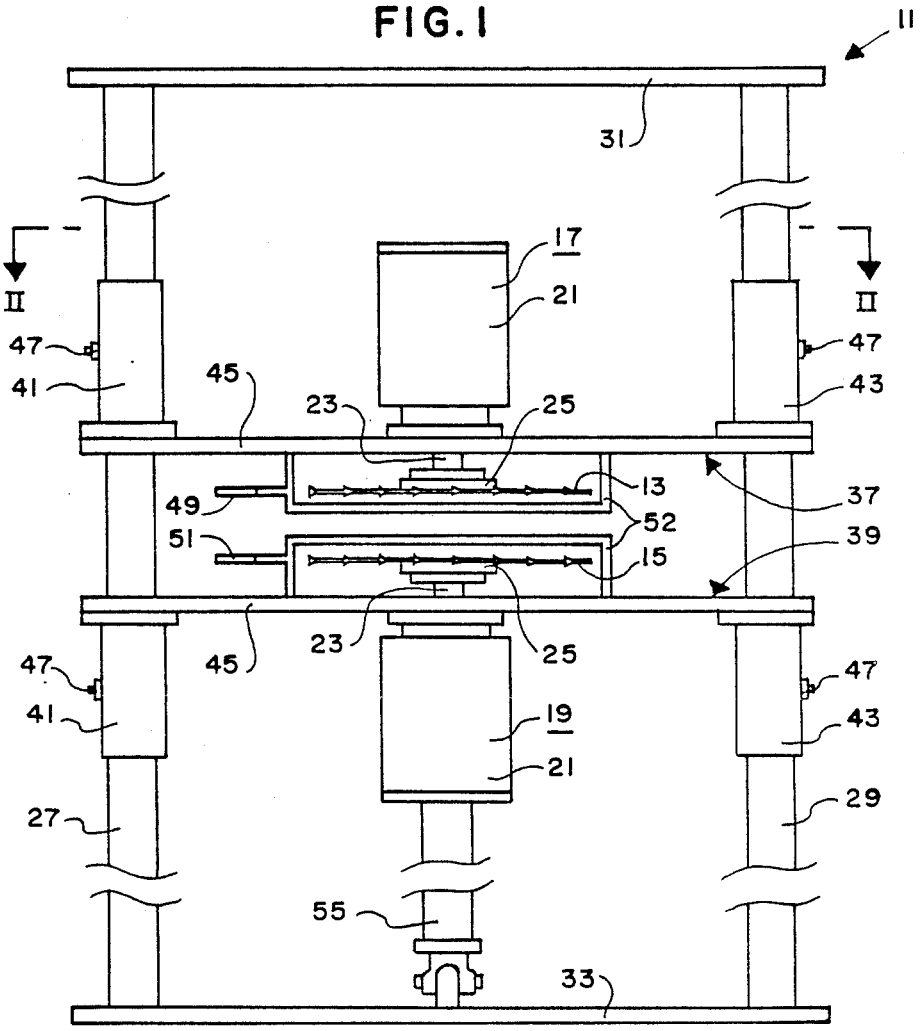
FIG. 1 is a front elevation of the vertical edger of the present invention.

The preferred embodiment of the vertical edger of the present invention is identified by the numeral 11 and is used to make parallel horizontal cuts or kerfs K in a log L as the log L is conveyed through a sawmill by a typical conveying means C. The vertical edger 11 is used in the sawmill to edge boards before the boards are cut off the log L by a vertical saw such as a large band saw or the like.

The vertical edger 11 includes an upper horizontal cutting blade 13 and a lower horizontal cutting blade 15. Each horizontal cutting blade 13, 15 is typically a standard circular saw consisting of a circular metal plate or disk with a toothed edge and having a central aperture 16 for being attached to a drive shaft or the like.

The vertical edger 11 includes drive means for rotatably driving the horizontal cutting blades 13, 15. The drive means preferably includes a first drive means 17 coupled to the upper horizontal cutting blade 13 for rotatably driving the upper horizontal cutting blade 13 and a second drive means 19 coupled to the lower horizontal cutting blade 15 for rotatably driving the lower horizontal cutting blade 15. Each drive means 17, 19 preferably includes an electric motor 21 and a rotatable drive shaft 23 for being nonmovably attached to the respective horizontal cutting blade 13,15 by an appropriate mechanical connection 25 or the like as will now be apparent to those skilled in the art.

The vertical edger 11 includes a first vertical column 27 and a second vertical column 29. The vertical columns 27, 29 are preferably parallel with one another and are spaced apart from one another a distance which allows the horizontal cutting blades 13, 15 and drive means 17, 19 to be located therebetween. The vertical edger 11 may include an upper plate 31 extending between the upper ends of the vertical columns 27, 29 and a lower plate 33 extending between the lower ends of the vertical columns 27, 29 for allowing the vertical columns 27, 29 to be rigidly joined to one another. The vertical edger 11 may include additional vertical columns 35 spaced from the vertical columns 27, 29 and extending between the upper and lower plates 31, 33 whereby the vertical columns 27, 29, 35 and plates 31, 33 will form an open, strong, rigid structure.

The vertical edger 11 includes slide means for slidably attaching at least one of the horizontal cutting blades 13, 15 to the vertical columns 27, 29. More specifically, the vertical edger 11 preferably includes an upper slide means 37 for attaching the upper horizontal cutting blade 13 to the vertical columns 27, 29 and for allowing the upper horizontal cutting blade 13 to move vertically along the vertical columns 27, 29 and preferably includes a lower slide means 39 for attaching the lower horizontal cutting blade 15 to the vertical columns 27, 29 and for allowing the lower horizontal cutting blade 15 to move vertically along the vertical columns 27, 29, Each slide means 37, 39 preferably includes a first sleeve member 41 slidably attached to the first vertical column 27, a second sleeve member 43 is slidably attached to the second vertical column 29, and a connector 45 extending between the first and second sleeve members. The connector 45 may consist of a substantially rigid plate with the sleeves 41, 43 attached to opposite ends thereof whereby each slide means 37, 39 will form a strong, rigid structure. Each sleeve 41, 43 may be provided with a typical grease fitting 47 or the like whereby grease may be introduced between each vertical column 27, 29 and each sleeve 41, 43 to allow the slide means 37, 39 to easily move vertically along the vertical columns 27, 29. The upper horizontal cutting blade 13 is preferably attached to the connector 45 of the upper slide means 37 and the lower horizontal cutting blade 15 is preferably attached to the connector 45 of the lower slide means 39. More specifically, the electric motor 21 of the first drive means 17 is preferably fixedly attached to the connector 45 of the upper slide means 37 by bolts or the like (not shown) with the drive shaft 23 thereof extending through an aperture (not shown).

Figure 2:
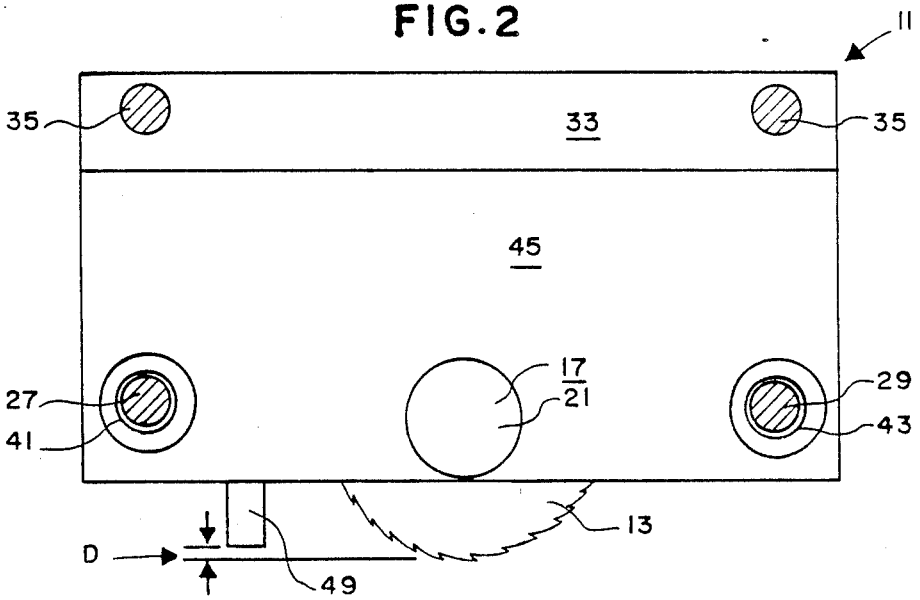
FIG. 2 is a sectional view substantially as taken on line II—II of FIG. 1.
Figure 3:
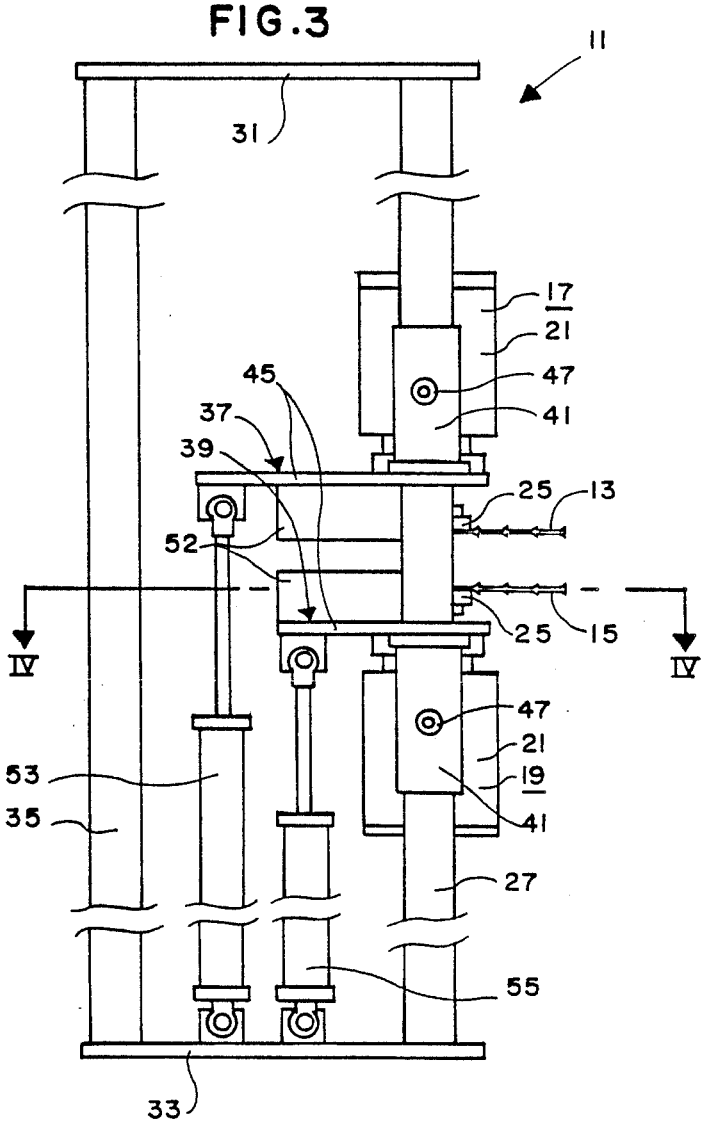
FIG. 3 is a side elevation of the vertical edger of the present invention.
Figure 4:
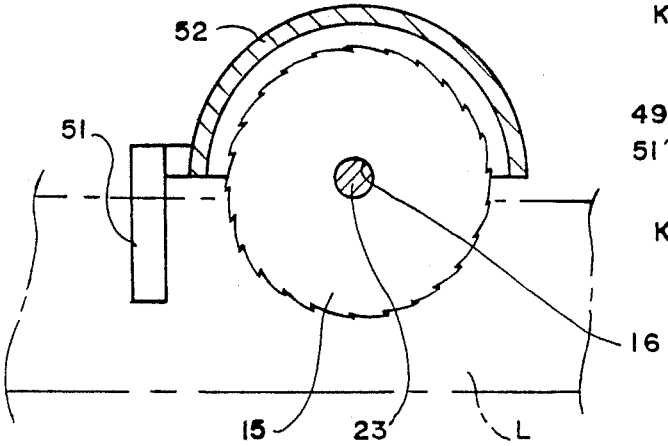
FIG. 4 is a sectional view substantially as taken on line IV—IV of FIG. 3 with portions thereof omitted for clarity.
Figure 5:
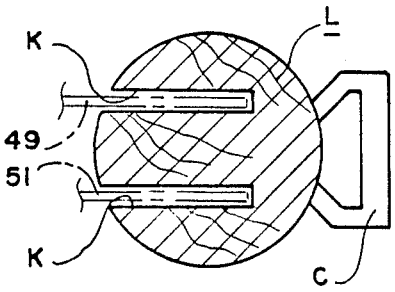
FIG. 5 is a cross-sectional view through a log showing a portion of a conveying means and showing a pair of kerfs as cut by the vertical edger of the present invention.

The vertical edger 11 preferably includes an upper key member 49 fixedly mounted relative to the upper slide member 37 for moving along the vertical columns 27, 29 with the upper slide means 37 and for extending into the kerf K cut into the log L by the upper horizontal cutting blade 13 and preferably includes a lower key member 51 fixedly mounted relative to the lower slide member 39 for moving along the vertical columns 27, 29 with the lower slide means 39 and for extending into the kerf K cut into the log L by the lower horizontal cutting blade 15. The upper and lower key members 49, 51 coact with one another to lock the log L relative to the horizontal cutting blades 13, 15 as the log L is conveyed past the horizontal cutting blades 13, 15. Each key member 49, 51 is sized so as to freely extend into the kerfs K and allow the log L to easily slide thereover. More specifically, the thickness of each key member 49, 51 is preferably slightly less than the thickness of the kerf K cut into the log L by the respective cutting blade 13, 15 as indicated by broken lines in FIG. 5 with the size differential exaggerated for clarity, and each key member 49, 51 preferably extends outward a distance slightly less than the outer periphery of the respective cutting blade 13, 15 (i.e., is slightly shorter than the kerfs K cut by the cutting blades 13, 15) as indicated by the arrow D in FIG. 2 and by broken lines in FIG. 5 with the size differential exaggerated for clarity. Each horizontal cutting blade 13, 15 is preferably partially covered by a guard member 52 for safety reasons, etc., as will now be apparent to those skilled in the art. Each guard member 52 may be fixedly attached to a connector 45 of a respective slide means 37, 39. The key members 49, 51 may, in turn, be fixedly attached to a respective guard member 52.

The vertical edger 11 includes means coupled to at least one of the slide means 37, 39 for causing that slide means to move vertically along the vertical columns 27, 29. More specifically, the means preferably includes a first piston means 53 coupled to the upper slide means 37 for causing the upper slide means 37 to move vertically along the vertical columns 27, 29 and for causing the upper horizontal cutting blade 13 to move vertically along the vertical columns 27, 29, and a second piston means 55 coupled to the lower slide means 39 for causing the lower slide means 39 to move vertically along the vertical columns 27, 29 and for causing the lower horizontal cutting blade 15 to move vertically along the vertical columns 27, 29. Each piston means 53, 55 may include a cylinder connected to the lower plate 33, a piston rod connected to the connector 45 of the respective slide means 37, 39, and typical controls (not shown) for selectively activating the cylinder and piston rod to cause the respective slide means 37, 39 to move thereby varying the distance between the horizontal cutting blades, etc., as will now be apparent to those skilled in the art.

The operation of the vertical edger 11 is as follows: As the conveying means C moves the first end of the log L to the vertical edger 11, an operator (which may be a computer) will set the height and spacing of the horizontal cutting blades 13, 15 depending on the diameter of the log L and the like by controlling the piston means 53, 55. The horizontal cutting blades 13, 15 will then cut horizontal kerfs K into the log L. As the log L is further conveyed, the key members 49, 51 will extend into the kerfs K and lock the log L relative to the vertical edger 11 as will now be apparent to those skilled in the art. The log L will remained locked to the vertical edger 11 by the key members 49, 51 until after the log L passes completely through the horizontal cutting blades 13, 15.

Although the present invention has been described and illustrated with respect to a preferred embodiment and a preferred use therefor, it is not to be so limited since modifications and changes can be meade therein which are within the full intended scope of the invention.

I claim

1. A vertical edger for cutting parallel horizontal kerfs in a log, said edger comprising:

(a) a first horizontal cutting blade;

(b) a second horizontal cutting blade;

(c) a first drive means coupled to said first horizontal cutting blade for rotatably driving said first horizontal cutting blade; said first drive means including a motor and a drive shaft for being rotated by said motor; said first horizontal cutting blade being nonslidably attached to said drive shaft of said first drive means;

(d) a second drive means coupled to said second horizontal cutting blade for rotatably driving said second horizontal cutting blade; said second drive means including a motor and a drive shaft for being rotated by said motor; said second cutting blade being nonslidably attached to said drive shaft of said second drive shaft;

(e) a stationary first vertical column;

(f) a stationary second vertical column spaced from said first vertical column;

(g) slide means for attaching said first horizontal cutting blade and said first drive means to said vertical columns and for allowing said first horizontal cutting blade to move vertically along said vertical columns; said slide means including a first sleeve member slidably attached to said first vertical column, a second sleeve member slidably attached to said second vertical column, and a connector extending between said first and second sleeve members; said first and second sleeve members limiting the movement of said slide means to vertical movement along the longitudinal axes of said first and second vertical columns; said first drive means and said first horizontal cutting blade being attached to said connector intermediate said first and second columns; and (h) means coupled to said slide means for causing said slide means to move vertically along said vertical columns and for causing said first horizontal cutting blade to move vertically along said vertical columns.

2. The vertical edger of claim 1 in which is included upper and lower key members for extending into the kerfs cut by said horizontal cutting blades to lock the log relative to said horizontal cutting blades.

3. The vertical edger of claim 2 in which each of said key members is slightly smaller in thickness that the kerfs cut by said horizontal cutting blades for allowing the log to easily slide along said key members.

4. The vertical edger of claim 3 in which each of said key members is slightly shorter than the kerfs cut by said horizontal cutting blades for allowing the log to easily slide along said key members.

5. A vertical edger for cutting parallel horizontal kerfs in a log, said edger comprising:

(a) an upper horizontal cutting blade;

(b) a lower horizontal cutting blade;

(c) a first drive means coupled to said upper horizontal cutting blade for rotatably driving said upper horizontal cutting blade; said first drive means including a motor and a drive shaft for being rotated by said motor; said upper horizontal cutting blade being nonslidably attached to said drive shaft of said first drive means;

(d) a second drive means coupled to said lower horizontal cutting blade for rotatably driving said lower horizontal cutting blade; said second drive means including a motor and a drive shaft for being rotated by said motor; said lower horizontal cutting blade being nonslidably attached to said drive shaft of said second drive means;

(e) a stationary first vertical column;

(f) a stationary second vertical column spaced from said first vertical column;

(g) a third vertical column spaced from said first and second vertical columns;

(h) a fourth vertical column spaced from said first and second vertical columns;

(i) an upper plate extending between the upper ends of said vertical columns for rigidly joining the upper ends of said vertical columns to one another;

(j) a lower plate extending between the lower ends of said vertical columns for rigidly joining the lower ends of said vertical columns to one another;

(k) an upper slide means for attaching said upper horizontal cutting blade and said first drive means to said vertical columns and for allowing said upper horizontal cutting blade to move vertically along said vertical columns; said upper slide means including a first sleeve member slidably attached to said first vertical column, a second sleeve member slidably attached to said second vertical column, and a connector extending between said first and second sleeve members; said first and second sleeve members limiting the movement of said upper slide means to vertical movement along the longitudinal axes of said first and second vertical columns; said first drive means and said upper horizontal cutting blade being attached to said connector of said upper slide means intermediate said columns;

(l) a lower slide means for attaching said lower horizontal cutting blade and said second drive means to said vertical columns and for allowing said lower horizontal cutting blade to move vertically along said vertical columns; said lower slide means including a first sleeve member slidably attached to said first vertical column, a second sleeve member slidably attached to said second vertical column, and a connector extending between said first and second sleeve members; said first and second sleeve members limiting the movement of said lower slide means to vertical movement along the longitudinal axes of said first and second vertical columns; said second drive means and said lower horizontal cutting blade being attached to said connector of said lower slide member intermediate said columns;

(m) an upper key member attached to said connector of said upper slide member for extending into the kerf cut into the log by said upper horizontal cutting blade;

(n) a lower key member attached to said connector of said lower slide member for extending into the kerf cut into the log by said lower horizontal cutting blade; said upper and lower key members coacting to lock the log relative to said horizontal cutting blades;

(o) first piston means coupled to said connector plate of said upper slide means for causing said upper slide means to move vertically along said vertical columns and for causing said upper horizontal cutting blade to move vertically along said vertical columns; and (p) second piston means coupled to said connector plate of said lower slide means for causing said lower slide means to move vertically along said vertical columns and for causing said lower horizontal cutting blade to move vertically along said vertical columns.

* * * * *